US005236504A

United States Patent [19]

Frikker

[11] Patent Number: 5,236,504

[45] Date of Patent: Aug. 17, 1993

[54] DEVICE FOR THE SPRAY-COATING OF OBJECTS

[75] Inventor: Jozsef Frikker, Dreieich, Fed. Rep. of Germany

[73] Assignee: ABB Flakt Ransburg GmbH, Fed. Rep. of Germany

[21] Appl. No.: 846,548

[22] Filed: Mar. 5, 1992

[30] Foreign Application Priority Data

Mar. 6, 1991 [DE] Fed. Rep. of Germany ..... 4107094

[51] Int. Cl.[5] ..... B05C 15/00

[52] U.S. Cl. ..... 118/323; 118/324

[58] Field of Search ..... 118/323, 324, 309, 315; 239/227, 264, 751, 752

[56] References Cited

U.S. PATENT DOCUMENTS 5,092,307 3/1992 Behr et al. ..... 118/315

*Primary Examiner*—Peter Chin
*Assistant Examiner*—Charles K. Friedman
*Attorney, Agent, or Firm*—Ostrolenk, Faber, Gerb & Soffen

[57] ABSTRACT

A device for automatically spray coating objects which move along a path along a theoretical Y axis. A first rotatable disk is supported to rotate around its own first axis. The disk is in a plane that extends generally along a side of the path of the objects. The first disk is rotatable around an axis that extends across the path of the objects. A second disk is supported on the first disk and has a second rotary axis which is eccentric to and generally parallel to the first axis. A spray device includes a carrier supported on the second disk on a third rotary axis eccentric to the second rotary axis. Rotation of the first disk with respect to the support, or the second disk with respect to the first disk or the carrier with respect to the second disk orients the spray device. The spray device carrier may also be moveable along its own third axis to position the spray device. Alternatively, there may be two sets of disks on opposite sides of the path and the carrier extends between the two second disks which rotate together.

20 Claims, 3 Drawing Sheets

DEVICE FOR THE SPRAY-COATING OF OBJECTS

BACKGROUND OF THE INVENTION

The present invention relates to a device for the spray-coating of objects which are moved past the spray coating device. The device of the invention is preferably used as a so-called "roof machine" for the automatic coating of the front, roof and rear surfaces of automobile bodies with paint, normally enamel. The automobile bodies are transported past the device on a conveyor belt.

Such a roof machine is known from Federal Republic of Germany OS 39 11 454 A1. The machine includes a roof beam which extends horizontally and transversely over the conveyor belt. The beam is provided with spray coating atomizers. The roof beam is supported on two vertical columns. One column contains drive elements for the roof beam and the atomizers. The other column contains paint supply means for supplying the atomizers with paint. The roof beam is connected to the vertical columns via crank-like levers so that the roof beam can be moved upward and downward and can have rotary movement around its longitudinal axis. The atomizers are jointly movable back and forth, are tiltable and are adjustable individually with respect to their lateral distances apart. Particularly when devices of this type are used as roof machines for automatically coating automobile bodies, they spray the paint or enamel from containers or pipe lines in optimum quality and quantity onto the objects to be sprayed, particularly automobile bodies. In practice, a large number of problems arise with such machines:

a) economy of the transfer of the paint, particularly the transfer of the paint from atomizers to the object to be coated with minimum loss of paint and minimum expenditure of energy;
b) good coating quality;
c) avoidance of electric voltages which are dangerous or otherwise detrimental;
d) dirtying of the device by particles of paint;
e) rapid change from one type of paint to another without the presence of disturbing residues of the first type of paint (rapid change of paint);
f) consideration of the flow of air in the spray booth in which the device is used;
g) small disturbances of the slight but continuous and laminar flow of air necessary in the spray booth lead to losses of paint on the path of the paint between the atomizer and the object to be coated and cause dirtying of the device;
h) as a roof machine, the device is intended to coat not only the roof but also the front and rear surfaces of the automobile bodies; for this purpose, the atomizers must be moved through spaces between successive automobile bodies and past the bodies and must be directed in different directions of spray;
i) since the automobile bodies are moved on a conveyor belt, the atomizers must be movable toward or transversely to the automobile bodies, depending on where the coating is required;
j) upon a change in or improvement of any of the above mentioned requirements, no other disadvantages may result.

In known devices for automatic spray coating of objects, many of their parts are arranged within the spray booth, which is made necessary by their construction. As a result, the parts are dirtied by paint and this disadvantageously affects the stream of air flowing in laminar form slowly downward in the spray booth.

SUMMARY OF THE INVENTION

The object of the invention is to reduce or avoid the above noted disadvantages and particularly to provide a device which is less disturbing to the air flow in the spray booth and which is dirtied less than the known devices. Another object is to develop the device so that one or more atomizers can be moved in any desired linear or curved paths of movement, in each case without any of the other above noted problems arising.

A device for automatically spray coating of objects which move along a path, along a theoretical Y axis. A first rotatable disk is supported to rotate around its first axis, the disk is in a plane that extends generally along the path of the objects and perpendicular to the path of the objects, but does not cross the path of the objects as to obstruct the movement of the objects, and the first disk is arranged outside the path of movement of the objects. The first disk is rotatable around an axis that extends across the path of the movement. A second disk is supported on the first disk and has a second rotary axis which is eccentric to the first rotary axis of the first disk and is generally parallel to the first axis. The spray device includes a carrier supported on the second disk on a third rotary axis eccentric to the second rotary axis, whereby rotation of the first disk with respect to the support, the second disk with respect to the first disk and the carrier with respect to the second disk orients the spray device. The spray device carrier may also be moveable along its own third axis to position the spray device. Alternately, there may be two sets of disks on opposite sides of the path and the carrier extends between the two second disks which rotate together.

The invention enables many parts of the roof machine to be placed outside the spray booth rather than within it. In particular, it is possible to arrange essential parts of the device in a plane and to develop them as part of the inner wall of the spray booth. This enables substantially maintaining the advantageous linear flow of air in the spray booth and greatly reduces the dirtying of the device. Even with the device of the invention in a plane of an inner wall of the booth, any desired curved and linear movements can be produced and transmitted to a spray device. Another important advantage is that the device of the invention can be easily integrated into existing spray booths. For this, it is merely necessary to remove parts of a wall of the spray booth and replace them by the device of the invention.

Other objects, features and advantages of the present invention will become apparent from the following description of the invention which refers to the accompanying drawings.

DESCRIPTION OF THE PREFERRED EMBODIMENTS

Figure 2:
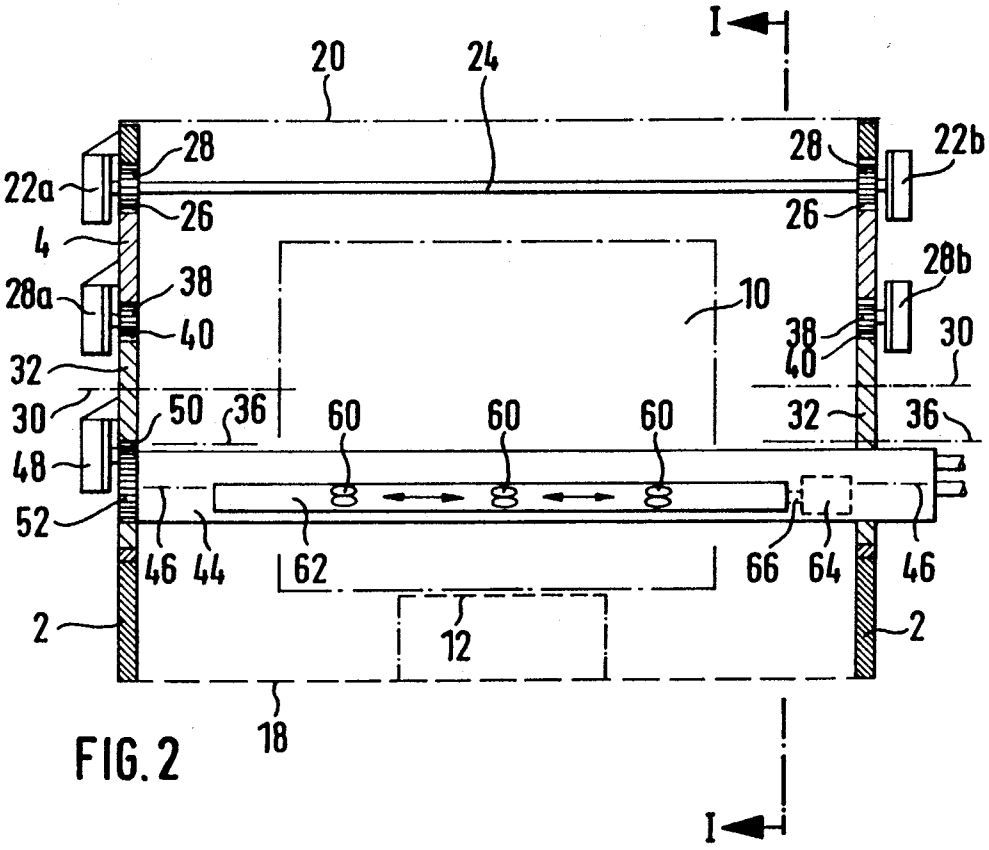
FIG. 2 is a cross-sectional view of the device of FIG. 1, and seen along the plane II—II of FIG. 1.
Figure 1:
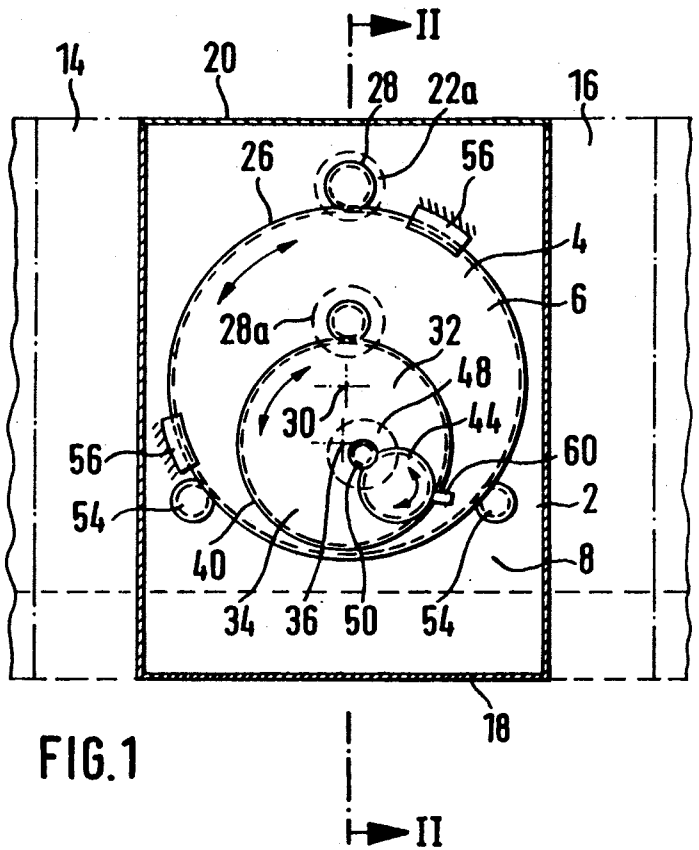
FIG. 1 diagrammatically shows a side view of the device of the invention for the automatic, preferably electrostatic, spray coating of automobile bodies, and seen from the inside of the booth and along the plane I—I of FIG. 2.
Figure 3:
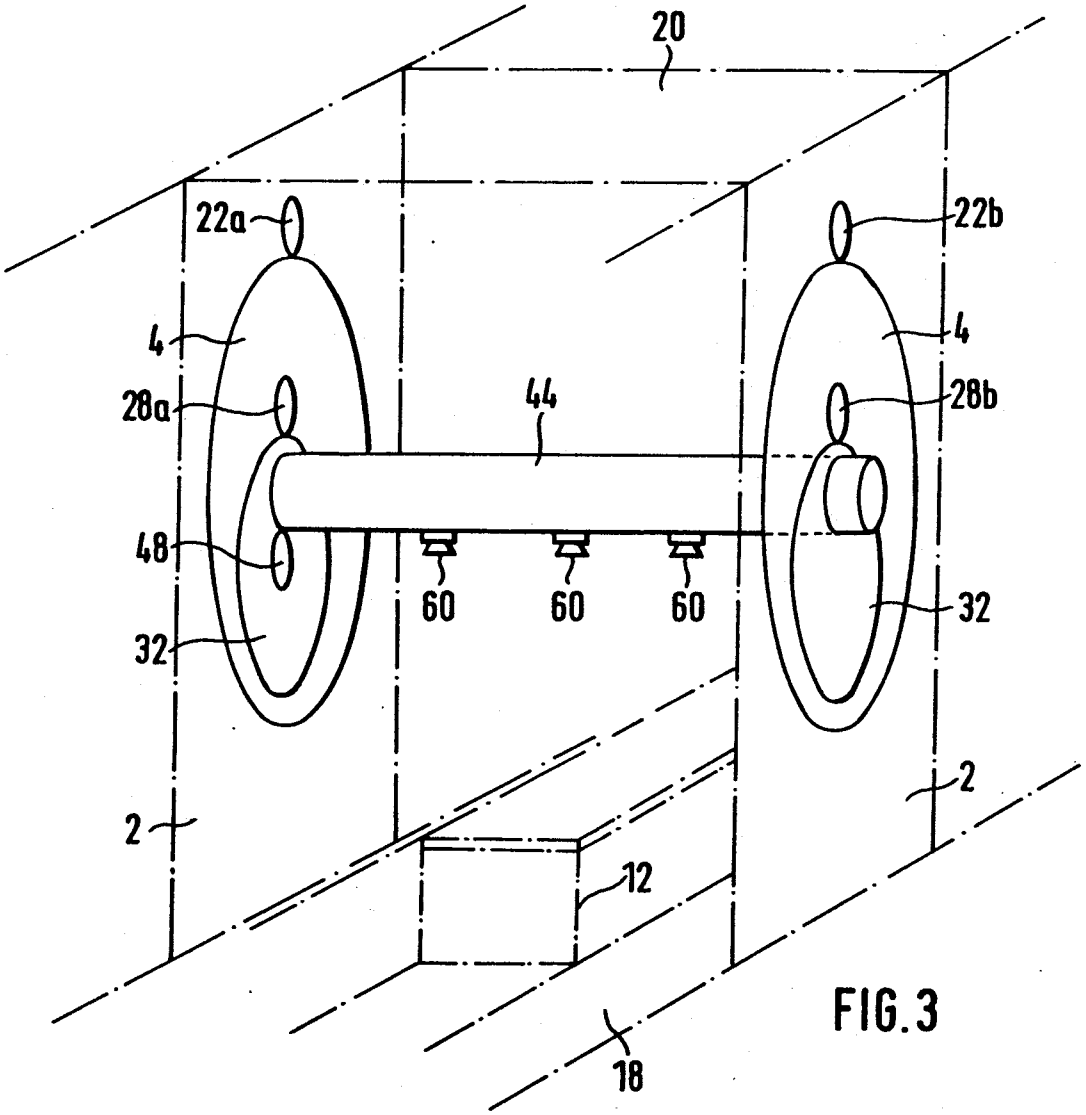
FIG. 3 is a diagrammatic perspective view of the device according to FIGS. 1 and 2.

The device in accordance with the invention shown in FIGS. 1 to 3 replaces parts of one side wall of a spray booth or preferably both side walls on both opposite, longitudinal sides of the booth by a respective support frame 2 of the device. Within each frame 2, a disk 4 of large diameter is rotatably mounted. The interior surface 6 of the disk 4 preferably lies in the same plane as the inner surface 8 of the frame 2 and that plane is outside of, but generally parallel to, the path of the objects being coated and would not intersect the path of the objects. The disks 4 on the two opposite wall frames 2 are arranged opposite each other and the disks 4 are on a common axis. The disks 4 are each located near and to the sides of the path of movement of the automobile bodies 10 to be coated. The automobile bodies 10 are transported on a conveyor belt 12 in known manner through the booth and thus also between the two disks 4. The parts of the side walls of the booth which lie alongside the frame 2 are provided with the reference numbers 14 and 16 in FIG. 1. The bottom of the booth is formed in known manner by a grate 18. The roof of the booth is formed by a filter 20 which filters the air which, in known manner, flows slowly downward in laminar form through the booth.

The large disks 4 on opposite sides of the booth, referred to below as first disks, are driven to rotate by motors 22*a* and 22*b*, respectively. These motors are arranged on the outside of the booth and they are fastened on the frame 2. The two motors 22*a* and 22*b* drive the two first disks 4 synchronously, i.e. at the same speed of rotation to rotate around their respective first axes of rotation. The synchronous travel of the two first disks 4 can be assured by known electrical circuits or mechanically by a shaft 24 connecting the disks 4 to each other. However, an electric circuit is preferred, since the shaft 24 can interfere with the flow of air in the booth. The motors can be electric motors or some other known drive device. Each first disk 4 has a gear toothed rim 26 which engages a gear 28 which is seated on and driven to rotate by the shaft of each motor 22*a* and 22*b*.

In a receiving space in the first disk 4, eccentric to its first axis of rotation 30, there is integrated a smaller second disk 32. The inner surface 34 of the disk 32 lies on the inside of the booth and is preferably flush with the inner surface 6 of the first disk 4 which is, in turn, flush with the inner surface 8 of the frame 2 so that the first and second disks are in the same plane. The second axis of rotation 36 of the second disk 32 is displaced eccentrically from and extends parallel to the first axis of rotation 30 of the first disk 4. Motors 28*a* and 28*b* are fastened on the respective ones of the two first disks 4 on the respective booth outer sides. The gears 28 are fastened on their shafts and engage with a gear toothed rim 40 of the respective second disks 32. The two motors 28*a* and 28*b* must drive the two second disks 32, which are axially spaced from each other, at the same speed of rotation. This synchronous travel can be obtained, in a manner similar to the motors 22*a* and 22*b* of the first disks 4, by an electric synchronization circuit or mechanically in known manner. Here also, electric synchronization is preferred to mechanical synchronization, so that no components within the booth can disturb the flow of air through the booth.

In the two first disks 4, there is rotatably mounted at least one carrier 44 having a third axis of rotation 46 which is eccentric to and is a parallel axis to the axis of rotation 36 of the second disks 32. A motor 48 is fastened on the outside of one of the two second disks 32. A gear 50 is seated on the shaft of the motor and engages a gear rim 52 of the carrier 44 so that the motor 48 can turn the carrier 44 around its axis of rotation 46. The motors 22*a*, 22*b*, 28*a* and 28*b* as well as 48 are preferably electric motors. Hydrostatic motors could, however, also be used.

In a modified embodiment, a different known drive device could also be used. Instead of the transmission of the rotary movement by gears 28 and 50 and gear rims 26, 40 and 52, it is also possible to drive the first disks 4 and second disks 2 as well as the carrier 44 by other drive means, for instance, by chains or belts. The radial mounting of the first disks 4 can be effected by guide wheels, in the present case guide gear wheels 54, which are rotatably mounted on the frame 8. In a similar fashion, the second disks 32 can also be radially mounted. For the axial guidance of the first disk 4, guide elements 56 can be fastened on the frame 2. By means of similar guide elements 56 (not shown) on the first disks 4, the second disks 32 can also be axially guided in the first disks.

The carrier 44 carries a spray device which is in the form, for instance, of three atomizers 60. Furthermore, a linear reciprocation device 62 is integrated in the carrier 44. This enables the atomizers as desired, to be moved jointly or individually in the direction along the axis of rotation 46 of the carrier 44 and thus parallel to the respective axes of rotation 30 and 36 of the first disks 4 and the second disks 32. The linear reciprocation device 62 can, for instance, contain an electric motor 64, which in known manner drives a threaded nut by which a threaded spindle 66 of the linear reciprocation device 62 is moved axially. However, other drive means are also possible, for instance toothed belt drives or piston-cylinder drives. By rotary movements of the first disks 4 in the frame 2 combined with rotary movements of the second disks 32 in the first disks, the carrier 44 can be moved optionally linearly and along any desired curved paths of movement in the longitudinal direction of the booth and the vertical direction of the booth. In this way, the carrier 44 together with the spray device 60 can be brought to any desired place above, in front of, or behind an automobile body to be coated. Furthermore, by turning the carrier 44 around its axis of rotation 46, the spray device 60 can be set in any desired direction of spray relative to the automobile body 10 to be coated. In this way, it is also possible to move the spray device 60, with respect to a conveyed automobile body 10, either in the same direction as, or opposite the direction of movement of the body or in such a way that the spray device 60 does not carry out any relative movement with respect to the automobile body 10.

In this embodiment, the device constitutes a so called roof machine, since, with it, the upward facing surfaces of the automobile bodies can be coated. It is also possible with the device to coat the automobile body surfaces which face toward the front and toward the rear. Further, the device of the invention has more universal applicability, as it can be used in the spray coating and- /or painting of almost any article which can be moved through a spray coating booth.

Figure 4:
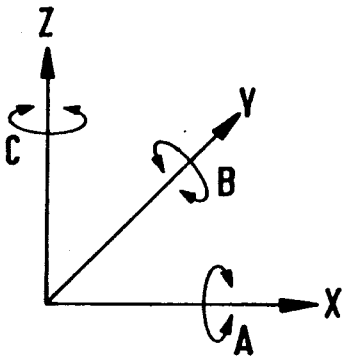
FIG. 4 is a direction diagram which explains various direction indications.

For robots, the different robot movements are defined in German VDI Guidelines 2861, Sheet 1, corresponding to FIG. 4 shown here. If this definition is applied to the movements of the device in accordance with the invention, then the different possibilities of movement can be designated as follows:

Y-axis: horizontal direction of movement (left or right) of the objects to be coated through the spray booth.

X-axis: horizontal direction of movement (up and down) at right angles to the Y-axis.

Z-axis: vertical direction of movement (forward and back) in each case at right angles to the Y and X axes.

In accordance with this standard, furthermore, rotations around the Y-axis are referred to as "B" rotations; rotations around the X-axis as "A" rotations; and rotations around the Z axis as "C" rotations.

If these designations are transferred to the device in accordance with the invention, then the automobile bodies 10 to be coated are moved along the Y-axis. The axes of rotation 30 and 36 of the first disks 4 and the second disks 32 extend along the X-axis and make an "A" rotation of each individual disk possible. The axis of rotation 46 of the carrier 44 also extends in the direction of the X-axis and permits "A" rotations.

By combination of the above-mentioned rotary movements and the linear movements of the spray device 60, the following possible movements of the device of the invention result:

Z-axis: simultaneous vertical movements, adapted to each other, of the first eccentric disks 4 and of the second disks 32 which are arranged eccentrically the first disks.

Y-axis: simultaneous forward and rearward movements, adapted to each other, of the first disks 4 and of the second disks 32 arranged eccentrically thereto.

X-axis: linear lateral movements of the spray device 60 caused by the linear reciprocation device 62.

A-rotation: rotation of the carrier 44 around its axis of rotation 46 by means of the motor 48.

Included herein also are the possibilities of having the spray device 60 follow the automobile body 10 as it is moved by the conveyor belt 12 or of having the spray devices travel in the direction opposite that of the automobile body 10 which is to be coated. All of the above noted movements can be combined and together provide an optimal possibility for coating automobile bodies and any other objects.

The device of the invention can replace conventional roof machines and robots which were previously used for the spray coating of roofs, engine hoods and trunk lids of automobile bodies and for coating other objects.

One essential advantage of the invention is, furthermore, that the fluid conduits required for the spray device or the atomizers 60 can be passed in simple manner through the carrier 44 without their providing a disturbance in the booth or becoming dirty.

Figure 5:
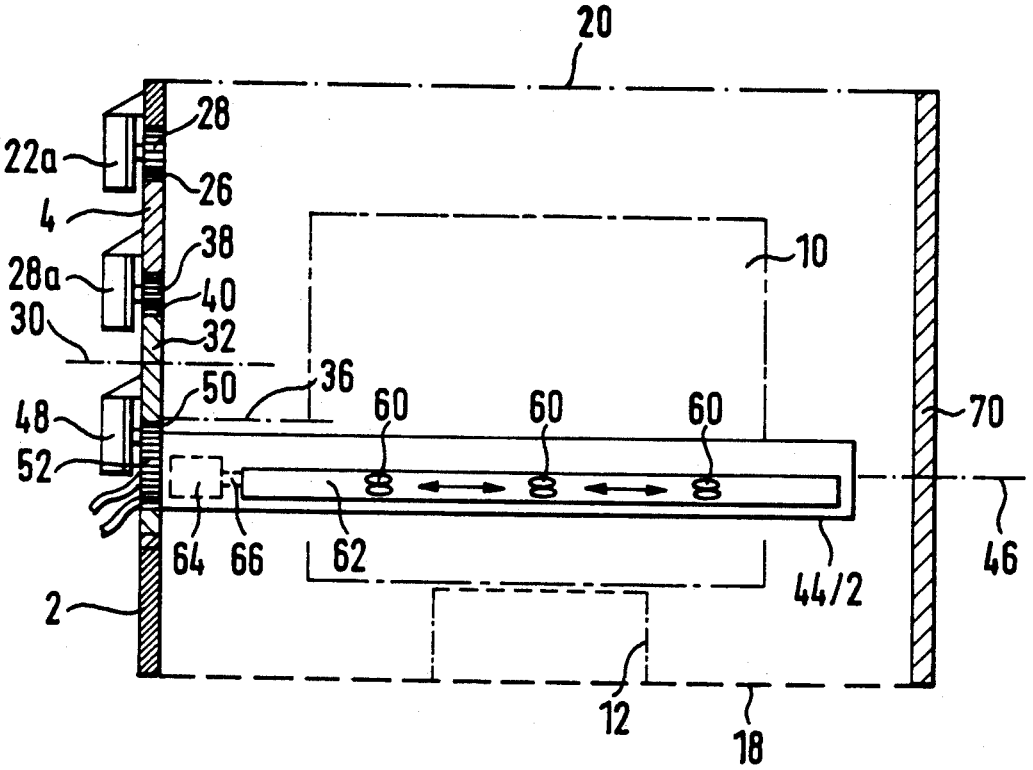
FIG. 5 is a diagrammatic cross section similar to FIG. 2 but of another embodiment of a device according to the invention for the automatic, preferably electrostatic, spray-coating of automobile bodies.

The embodiment of the device of the invention shown in FIG. 5 is identical to the device shown in FIG. 2, with the exception that the carrier 44, which is designated 44/2 in FIG. 5, is supported only by a set comprised of one first disk 4 and one second disk 32, shown on the left. This permits the carrier 44/2 to be of shorter length. The second set of a first disk 4 and a second disk 32, which is shown on the right in FIG. 2, is omitted in the embodiment of FIG. 5. Instead of this, a closed wall part 70 of the booth is provided there. In FIG. 5, similar parts have the same reference numbers as are used for the embodiment of FIGS. 1, 2 and 3. Since their functions are the same, they are not described again here. Nevertheless, it is possible to attach as many devices as desired for stabilizing the carrier 44 outside the booth, parallel to FIG. 5.

Another possibility of the invention, which is not shown in the drawing, is to not arrange the device shown in FIG. 5 in a side wall of a booth but to instead arrange it in the roof of a booth and to therefore turn it 90° in the clockwise direction. In this case, however, no air can be drawn through the roof of the booth inside the booth in the region of the device.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for spray coating of objects, wherein the objects are moveable along a path, the device comprising:

a first disk support;

a first rotatable disk supported on the support outside the path of the objects, the disk being oriented on the support in a first plane which is generally parallel to the path of the objects;

first means for rotating the first disk in the first plane around a first axis of rotation;

a second rotatable disk supported on the first disk, having a second axis of rotation which is eccentric of the first axis of rotation, the second disk also being oriented in the first plane;

second means for rotating the second disk around the second axis of rotation; and a spray device for spray coating the objects, said spray device being supported by the first disk for being moved to different positions with respect to the objects by rotations of the first and second disks.

2. The device of claim 1, wherein the spray device is carried on the second disk and is moved by rotation of the second disk with respect to the first disk and by rotation of the first disk with respect to the support.

3. The device of claim 12, wherein the first disk and the first plane thereof are oriented such that the first plane would not be intersected by the movement of the objects along the path; and the first axis of the first disk is perpendicular to the path of the objects.

4. The device of claim 3, wherein the spray device projects from the second disk on which the spray device is supported across the path of the objects to be coated.

5. The device of claim 4, further comprising linear reciprocation means supporting the spray device on the second disk and for moving the spray device perpendicularly across the path of the objects to be coated.

6. The device of claim 2, wherein the first and second axes of rotation of the first and second disks, respectively, are parallel.

7. The device of claim 2, wherein the first disk has a space therein for receiving and supporting the second disk therein, and the second disk is arranged in the space of the first disk and is rotatable with respect to the first disk in the space.

8. The device of claim 7, wherein the spray device supported on the second disk is moveable to various positions with respect to the path of the objects by a combination of rotary movement of the first and second disks, and the respective first and second means for rotating the first and second disks selectively rotate the disks for obtaining various linear and curved movements of the spray device relative to the objects.

9. The device of claim 8, wherein the spray device comprises a carrier supported on the second disk;

the carrier having a third axis of rotation which is eccentric to the second axis of rotation of the second disk and which is generally parallel to the second axis of rotation;

third drive means for rotating the carrier around the third axis of rotation; and spraying means on the carrier for spray coating the objects, the spraying means being redirected by rotations of the carrier and of the first and the second disks around their respective axes;

the first, second and third drive means being independently operable for rotating the spraying means into selected directions of spray relative to the objects.

10. The device of claim 9, further comprising linear reciprocation means connected with the carrier for selectively moving the carrier and the spraying means thereon to different positions along the third axis.

11. The device of claim 9, further comprising:

a second support, the first and second supports being located on opposite sides of the path of movement of the objects, so that the objects move along the path between the first and second supports, the second support supporting a respective second one of the first rotatable disks in a respective second plane which is also generally parallel to the first plane;

a respective one of the second rotatable disks which is supported eccentrically on the second of the first disks and in the second plane; the second one of the second disks also carrying the spray device;

the first and second supports are so placed and the respective first and second ones of the first disks are so placed on the first and second supports that the first disks are opposite each other and have substantially a common first axis of rotation;

the carrier extending between and being supported to rotate with respect to each of the second disks, and the third drive means being adapted for rotating the carrier with respect to both of the second disks.

12. The device of claim 2, further comprising a linear reciprocation device supporting the spray device and for moving the spray device perpendicularly across the path of the objects.

13. The device of claim 2, wherein the spray device is moveable generally in the first plane of the first disk by combinations of the rotary movements of the first and second disks for following in a particular pattern the contours of the objects to be coated.

14. The device of claim 2, further comprising:

a second support located opposite the first support across the path of movement of the objects, so that the objects move between the first and second supports; the second support supporting a respective second one of the first rotatable disks in a respective second plane which is parallel to the first plane;

a respective second one of the second rotatable disks which is supported eccentrically on the second of the first disks and in the second plane; the second one of the second disks also carrying the spray device; and respective second ones of the first and second means for rotating the second ones of the first and second disks around their respective first and second axes of rotation.

15. The device of claim 14, wherein the first and second supports are so placed and the first and second ones of the first rotatable disks are so placed on the respective first and second supports that the first disks are disposed opposite each other across the path of the objects and have substantially a common first axis of rotation, the spray device being supported jointly by each of the first and second ones of the second disks.

16. The device of claim 2, including a booth having opposed side walls, each side wall extending along a side of the path of the object to be coated, one of the side walls serving as the support, and the first disk being supported on the one side wall for rotation with respect to the one side wall in the first plane of the first disk.

17. The device of claim 2, further comprising a conveyor for conveying objects to be coated along the path of the objects through the booth.

18. A for spray coating objects moveable along a path comprising:

a first disk at a side of the path and supported to rotate on a first axis extending across the path;

a second disk supported to rotate on the first disk on a second axis parallel to and eccentric to the first axis;

a spray device projecting from the second disk into the path; and first and second means for selectively rotating the first and second disks, respectively.

19. The device of claim 19, wherein the spray device is rotatable on the second disk on a third axis eccentric to the second axis; and third means for selectively rotating the spray device.

20. The device of claim 19, further comprising means for moving the spray device along the third axis.

* * * * *